US009771839B2

(12) United States Patent
Wing et al.

(10) Patent No.: US 9,771,839 B2
(45) Date of Patent: Sep. 26, 2017

(54) CAMSHAFT PHASER SYSTEMS AND LOCKING PHASERS FOR THE SAME

(71) Applicant: BorgWarner Inc., Auburn Hills, MI (US)

(72) Inventors: Braman C. Wing, Ithaca, NY (US); Daniel Brown, Freeville, NY (US)

(73) Assignee: BORGWARNER INC., Auburn Hills, MI (US)

( * ) Notice: Subject to any disclaimer, the term of this patent is extended or adjusted under 35 U.S.C. 154(b) by 0 days.

(21) Appl. No.: 15/321,771

(22) PCT Filed: Jun. 22, 2015

(86) PCT No.: PCT/US2015/036928
§ 371 (c)(1),
(2) Date: Dec. 23, 2016

(87) PCT Pub. No.: WO2015/200190
PCT Pub. Date: Dec. 30, 2015

(65) Prior Publication Data

US 2017/0145874 A1 May 25, 2017

Related U.S. Application Data

(60) Provisional application No. 62/016,733, filed on Jun. 25, 2014.

(51) Int. Cl.
*F01L 1/34* (2006.01)
*F01L 1/352* (2006.01)
(Continued)

(52) U.S. Cl.
CPC ..... *F01L 1/352* (2013.01); *F01L 1/024* (2013.01); *F01L 1/053* (2013.01); *F01L 2001/0537* (2013.01)

(58) Field of Classification Search
CPC . F01L 1/352; F01L 1/024; F01L 1/053; F01L 2001/0537
(Continued)

(56) References Cited

U.S. PATENT DOCUMENTS 5,680,837 A 10/1997 Pierik
6,027,424 A 2/2000 Reynolds
(Continued)

FOREIGN PATENT DOCUMENTS

DE 102012207318 A1 11/2013
EP 2 006 501 A1 12/2008
(Continued)

OTHER PUBLICATIONS

International Search Report of PCT/US2015/036928 with mailing date of Sep. 24, 2015.
(Continued)

*Primary Examiner* — Zelalem Eshete
(74) *Attorney, Agent, or Firm* — Howard & Howard Attorneys PLLC

(57) ABSTRACT

A system (44) for controlling camshaft (28) phase in an engine (20) with a crankshaft (26), including: an actuator (42) driving a phaser (38) attached to the camshaft (28). The phaser (38) has a first portion (46) in communication with the crankshaft (26), a second portion (48) attached to the camshaft (28) and in communication with the first portion (46), and a third portion (50) attached to the actuator (42) and in communication with the second portion (48). One portion includes a receiver (52), and another portion includes a lock (54) having: a first position (78) where the portions with the receiver (52) and lock (54) can rotate with respect to each other; and a second position (80) where the portions with the receiver (52) and lock (54) are coupled. The lock (54) moves between positions in response to
(Continued)

predetermined torque differential between the actuator (42) and camshaft (28).

15 Claims, 10 Drawing Sheets

(51) Int. Cl.
*F01L 1/02* (2006.01)
*F01L 1/053* (2006.01)

(58) Field of Classification Search
USPC ..... 123/90.17
See application file for complete search history.

(56) References Cited

U.S. PATENT DOCUMENTS 7,377,245 B2 5/2008 Morii et al.
7,451,731 B2 * 11/2008 Eichenberg ..... F01L 1/352 123/90.15
9,334,762 B2 5/2016 Kuffner et al.
2006/0236965 A1 10/2006 Schaefer et al.
2009/0120388 A1 5/2009 Lee et al.
2010/0064997 A1 3/2010 Ai
2011/0253086 A1 10/2011 Walliser et al.
2012/0186548 A1 7/2012 David et al.

FOREIGN PATENT DOCUMENTS

JP 2005061244 A 3/2005
WO 20140092963 A1 6/2014

OTHER PUBLICATIONS

First Office Action and Search Report for PCT/US2015/036928/DE112015002518.9 issued Feb. 8, 2017, by the German Patent and Trademark Office.
International Search Report for Application No. PCT/US2015/046464 dated Oct. 26, 2015, 2 pages.

* cited by examiner

FIG. 2
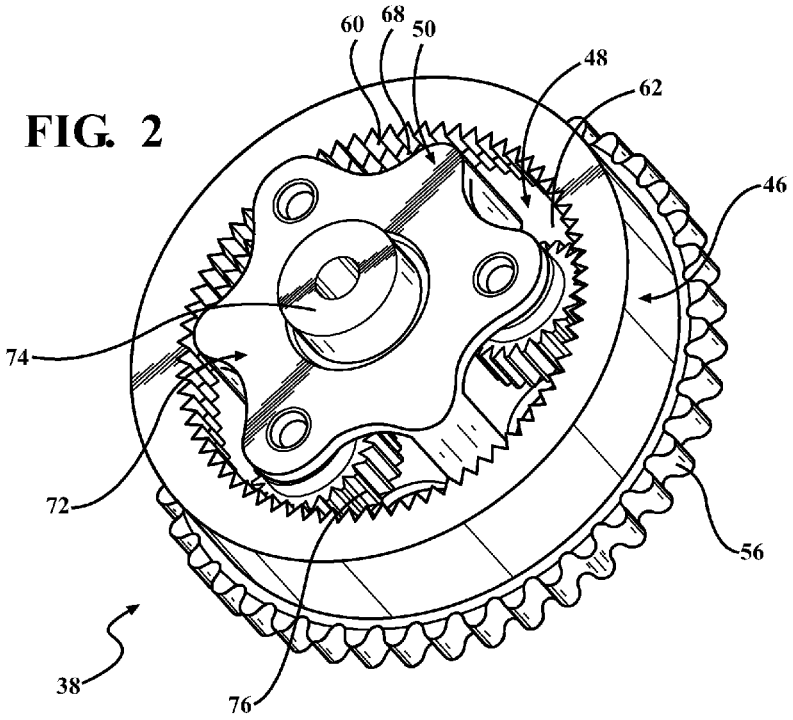
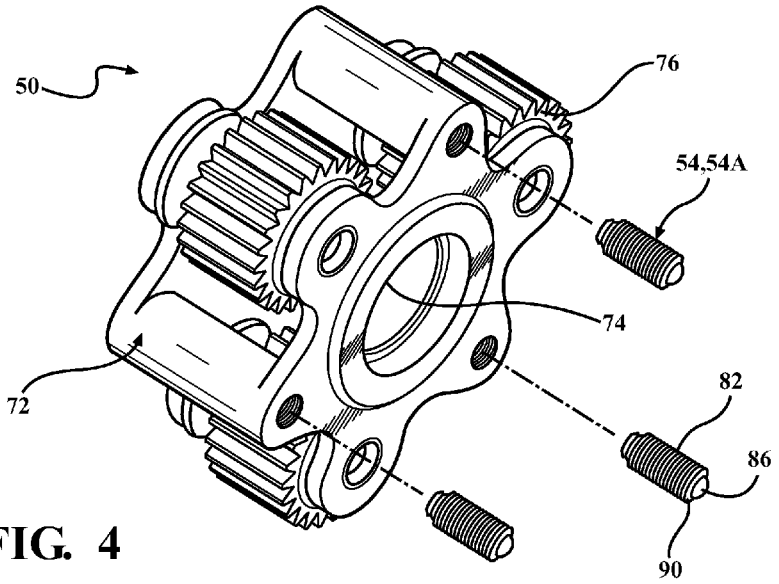
FIG. 4

CAMSHAFT PHASER SYSTEMS AND LOCKING PHASERS FOR THE SAME

CROSS REFERENCE TO RELATED APPLICATIONS

This application is a National Stage of International Patent Application No. PCT/US2015/036928 filed on Jun. 22, 2015, which claims priority to and all the benefits of U.S. Provisional Patent Application No. 62/016,733 filed on Jun. 25, 2014, both of which are hereby expressly incorporated herein by reference in their entirety.

BACKGROUND OF INVENTION

1. Field of Invention

The present invention relates, generally, to camshaft phaser systems and, more specifically, to locking phasers for camshaft phaser systems.

2. Description of the Related Art

Conventional automotive camshaft timing systems (sometimes referred to as "variable valve timing" systems) known in the art typically include an internal combustion engine that has a crankshaft and one or more camshafts controlled by one or more camshaft phasers. Phasers are used to alter the timing of valve events so as to improve engine performance, fuel economy, and emissions. Phasers are typically operatively attached to an end of the camshaft and are also in rotational communication with the engine crankshaft, so as to either advance or retard the phase of the camshaft with respect to the crankshaft. Phasers can be actuated in a number of different ways, and have historically been controlled using servo-controlled hydraulic pressure. However, the recent trend in the art is to control phasers with electric motors, which can provide broader phase control and improved response time. The electric motor and phaser are operatively attached to each other and in rotational communication so as to allow rotation of the electric motor to adjust the phase angle of the camshaft. The electric motor is typically controlled by an engine control unit (ECU), which also controls fuel delivery and ignition timing.

Electric motors used with camshaft phasers known in the art are typically brushless DC electric motors, which provide longer life, better control, and faster response than conventional brushed DC electric motors. To that end, phasers driven by electric motors are better able to optimize the phase of the camshaft so as to provide increased engine performance and response, as well as improved emissions. To cooperate with the electric motors, phasers known in the art may include a friction-based locking mechanism to lock (or, "park") the phaser in one or more optimal pre-determined positions, depending on vehicle and engine operating conditions.

Each of the components of a camshaft phaser system of the type described above must cooperate to effectively control the phase angle of the camshaft. In addition, each of the components must be designed not only to facilitate improved performance and efficiency, but also so as to reduce the cost and complexity of manufacturing and assembling the system. While camshaft phaser systems known in the related art have generally performed well for their intended purpose, there remains a need in the art for a camshaft phaser system that has superior operational characteristics, and, at the same time, reduces the cost and complexity of manufacturing the components of the system, as well as the overall dimensions of the various components.

SUMMARY OF THE INVENTION

The present invention overcomes the disadvantages in the related art in a system for controlling the phase between a camshaft and a crankshaft of an internal combustion engine. The system includes an actuator and a phaser. The phaser is operatively attached to the camshaft and is driven by the actuator so as to selectively control the phase of the camshaft. The phaser includes: a first portion in rotational communication with the crankshaft, a second portion operatively attached to the camshaft and disposed in rotational communication with the first portion, and a third portion operatively attached to the actuator and disposed in rotational communication with the second portion. One of the portions of the phaser includes a receiver, and another of the portions of the phaser includes a lock for releasably engaging the receiver. The lock has a first position wherein the portion which includes the receiver and the portion which includes the lock can rotate with respect to each other, and a second position wherein the portion which includes the receiver is rotatably coupled to the portion which includes the lock. The lock is movable between the first position and the second position in response to a predetermined torque differential occurring between the actuator and the camshaft.

In addition, the present invention is directed toward a phaser actuated by an electric motor for controlling the phase between a camshaft and a crankshaft of an internal combustion engine. The phaser includes a first portion, a second portion, and a third portion. The first portion is in rotational communication with the crankshaft. The second portion is operatively attached to the camshaft, is in rotational communication with the first portion, and has a plurality of receivers spaced radially thereabout. The third portion is operatively attached to the electric motor, is in rotational communication with the second portion, and has a plurality of lock assemblies for releasably engaging the receivers of the second portion. The lock assemblies have a first position wherein the third portion and the second portion can rotate with respect to each other, and a second position wherein the third portion is rotatably coupled to the second portion. The lock assemblies are movable between the first position and the second position in response to a predetermined torque differential occurring between the second portion and the third portion.

Further, the present invention is directed toward a phaser actuated by an electric motor for controlling the phase between a camshaft and a crankshaft of an internal combustion engine. The phaser includes a first portion, a second portion, and a third portion. The first portion is in rotational communication with the crankshaft. The second portion is operatively attached to the camshaft, is in rotational communication with the first portion, and has a plurality of receivers spaced radially thereabout. The third portion is operatively attached to the electric motor, is in rotational communication with the second portion, and has a plurality of lever springs for releasably engaging the receivers of the second portion. The lever springs have: a first position wherein the third portion and the second portion can rotate with respect to each other, and a second position wherein the third portion is rotatably coupled to the second portion. The lever springs are movable between the first position and the second position in response to a predetermined torque differential occurring between the second portion and the third portion.

In this way, the present invention significantly reduces the complexity and packaging size of the phaser system and its associated components. Moreover, the present invention reduces the cost of manufacturing camshaft phaser systems that have superior operational characteristics, such as improved engine performance, control, and efficiency.

BRIEF DESCRIPTION OF THE DRAWINGS

Other objects, features, and advantages of the present invention will be readily appreciated as the same becomes better understood after reading the subsequent description taken in connection with the accompanying drawings wherein:

FIG. 2 is an enlarged perspective view of a camshaft phaser in an assembled configuration, according to one embodiment of the present invention.

FIG. 4 is a partially exploded view of the third portion of the camshaft phaser of FIG. 3 having locks as lock assemblies.

DETAILED DESCRIPTION OF THE INVENTION

Figure 1:
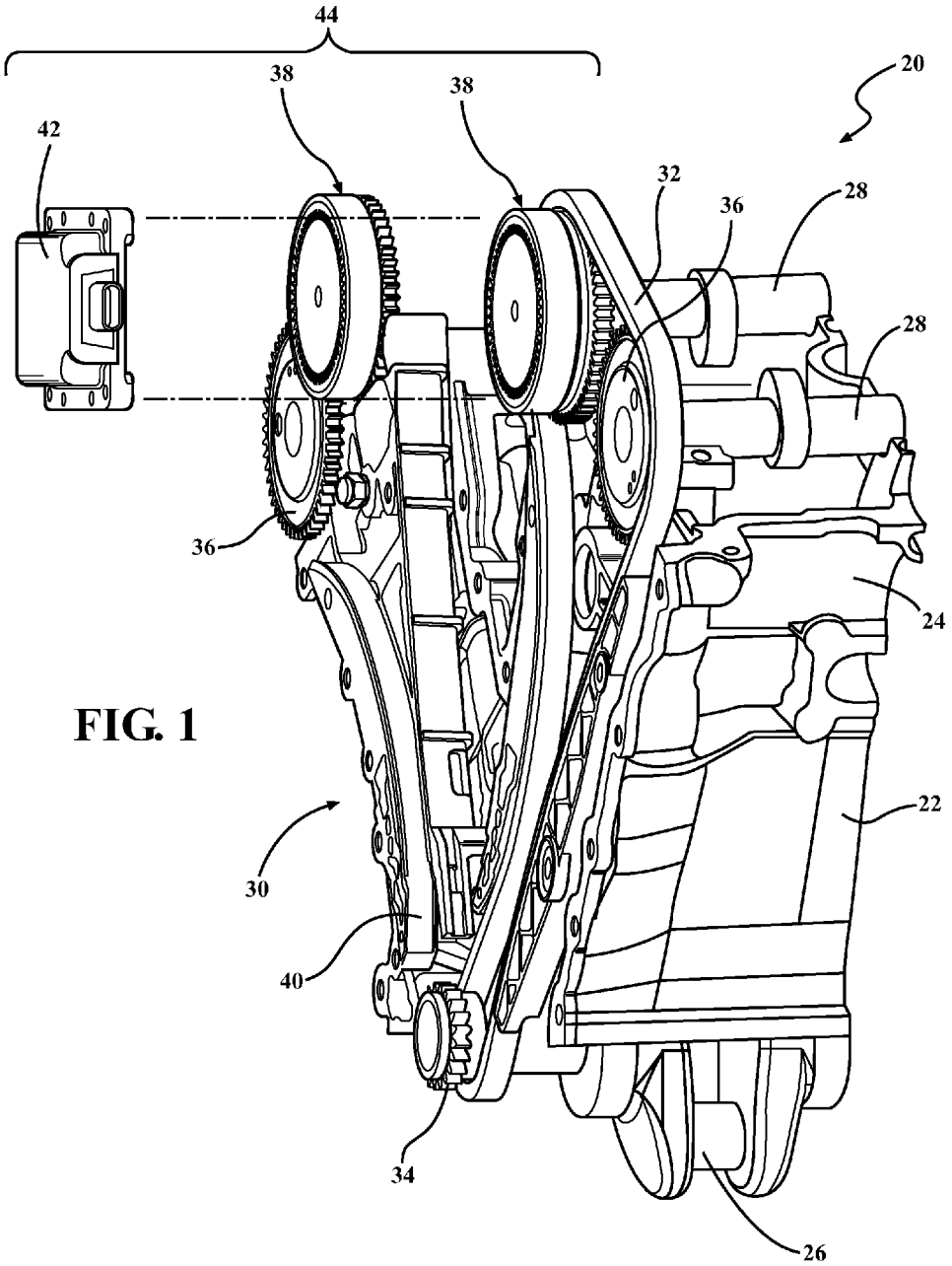
FIG. 1 is a partial exploded perspective view of an automotive engine showing a camshaft phaser and an electric motor, according to one embodiment of the present invention.

Referring now to the figures, where like numerals are used to designate like structure, a portion of an internal combustion engine of an automobile is illustrated at 20 in FIG. 1. The engine 20 includes a block 22 and one or more cylinder heads 24 mounted to the block 22. A crankshaft 26 is rotatably supported in the block 22, and one or more camshafts 28 are rotatably supported in the cylinder head 24. The crankshaft 26 drives the camshafts 28 via a timing system, generally indicated at 30. The timing system 30 typically includes a chain, generically shown at 32 in FIG. 1, which interconnects a crankshaft sprocket 34 to one or more camshaft sprockets 36 and phasers 38. The timing system 30 may also include a tension guide 40 to ensure proper tension of the chain 32 in operation. While the representative embodiment illustrated in FIG. 1 depicts a chain 32 and sprockets 34, 36, those having ordinary skill in the art will appreciate that the timing system 30 could utilize any suitable configuration sufficient to drive the camshafts 28 with the crankshaft 26 without departing from the scope of the present example. By way of non-limiting example, a timing belt in conjunction with timing gears could be utilized.

The engine 20 generates rotational torque which is subsequently translated by the crankshaft 26 to the camshafts 28 which, in turn, actuate valves (not shown, but generally known in the art) in the cylinder head 24 for controlling the timing of the flow of intake and exhaust gasses. Specifically, the camshafts 28 control what is commonly referred to in the art as "valve events," whereby the camshaft 28 opens and closes intake and exhaust valves at specific time intervals with respect to the rotational position of the crankshaft 26, so as to effect a complete thermodynamic cycle of the engine 20. While the engine 20 illustrated in FIG. 1 is a V-configured, dual-overhead-cam (DOHC), spark-ignition Otto-cycle engine, with phasers 38 on each intake camshaft 28, those having ordinary skill in the art will appreciate that the engine 20 could be of any suitable configuration, with any suitable number of camshafts 28 disposed in any suitable way, controlled using any suitable thermodynamic cycle, and with any suitable number of phasers 38, without departing from the scope of the present invention. As shown best in FIG. 1, the phasers 38 are operatively attached to an end of one or more camshafts 28 and are in rotational communication with the crankshaft 26. The phasers 38 are configured to adjust the phase of the camshaft 28 with respect to the crankshaft 26 so as to alter the timing of the valve events discussed above. To that end, the phasers 38 are typically in rotational communication with an actuator 42, such as an electric motor (not shown in detail, but generally known in the art) which is driven by a controller (not shown, but generally known in the art), such as an engine control unit (ECU). Thus, the phaser 38 and actuator 42 define a system 44 for controlling the phase between the camshaft 28 and crankshaft 26 of the engine 20, as discussed above. Each of these components will be described in greater detail below.

The actuator 42 actuates the phaser 38 and is operatively attached to and in rotational communication with the phaser 38, as described in greater detail below. While the actuator 42 shown and described herein is realized by a brushless DC electric motor, those having ordinary skill in the art will appreciate that the actuator 42 could be of any suitable type and could be configured in any suitable way, without departing from the scope of the present invention. By way of non-limiting example, the actuator 42 could be hydraulic. As such, the terms "actuator" and "electric motor" are used interchangeably herein in connection to reference to numeral 42.

Figure 3:
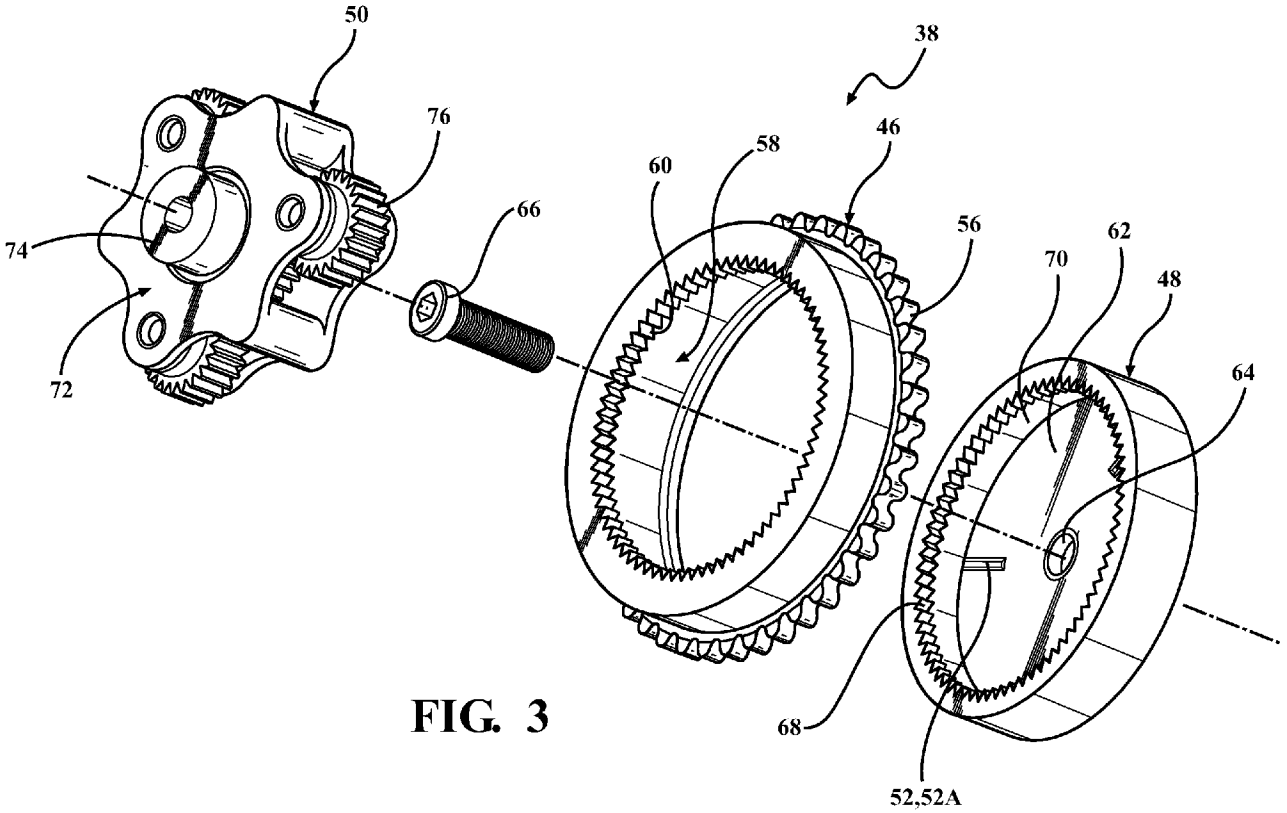
FIG. 3 is an exploded perspective view of the camshaft phaser of FIG. 2, having a first, second, and third portion.
Figure 10:
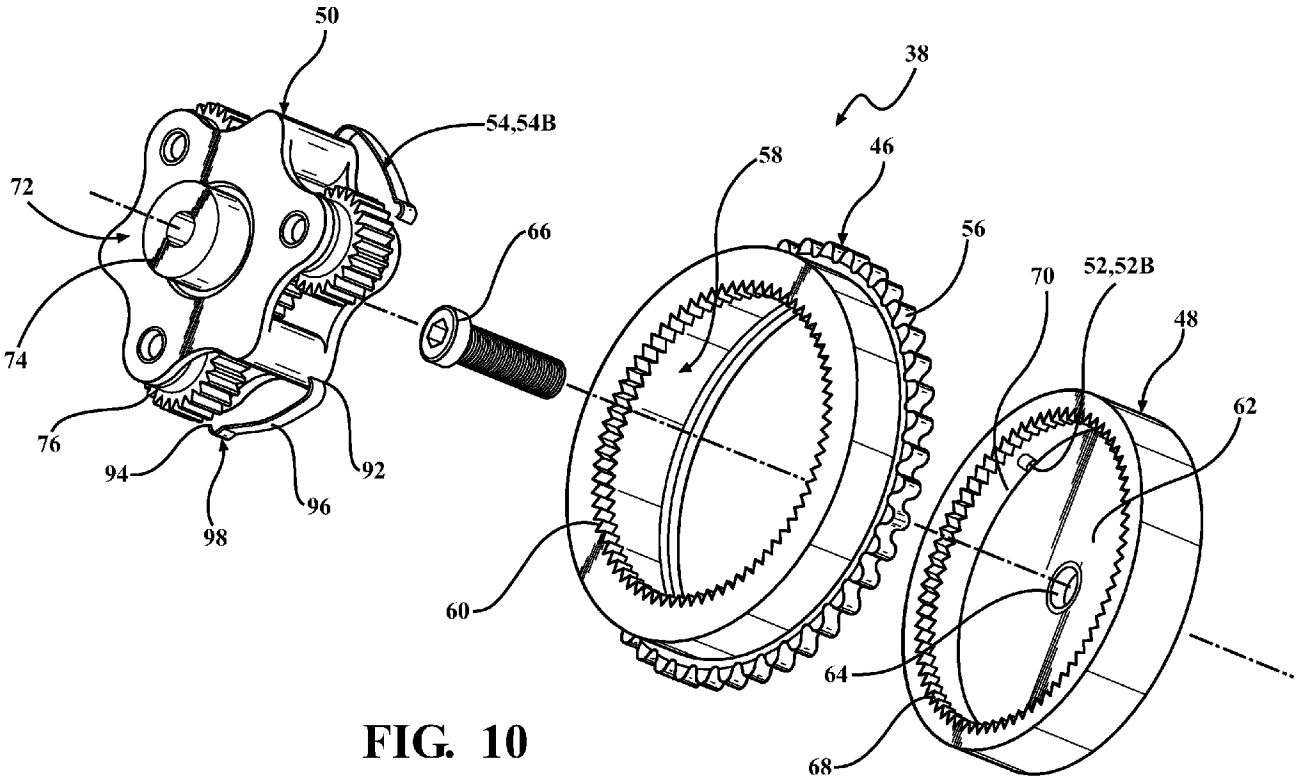
FIG. 10 is an exploded perspective view of the camshaft phaser of FIG. 9, having a first, second, and third portion.

As discussed above, the system 44 of the present invention also includes a phaser 38 operatively attached to the camshaft 28 and driven (or, "actuated") by the actuator 42 so as to selectively control the phase of the camshaft 28 with respect to the crankshaft 26 of the engine 20. As best shown in FIGS. 3 and 10, the phaser 38 includes a first portion 46, a second portion 48, and a third portion 50. The first portion 46 is in rotational communication with the crankshaft 26. The second portion 48 is operatively attached to the camshaft 28 and is in rotational communication with the first portion 46. The third portion 50 is operatively attached to the actuator 42 and is in rotational communication with the second portion 48. In the representative embodiment illustrated and described herein, the second portion 48 of the phaser 38 has at least one receiver, indicated at 52, and the third portion 50 of the phaser 38 has at least one lock, indicated at 54, for releasably engaging the receiver 52. However, those having ordinary skill in the art will appreciate that the specific configuration and/or arrangement of the receiver 52 and/or the lock 54 could be effected in a number of different ways without departing from the scope of the present invention. Specifically, it will be appreciated that any one of the portions of the phaser 38 could include the receiver 52 and any other one of the portions of the phaser 38 could include the lock 54. Moreover, as will be appreciated from the subsequent description below, the phaser 38 could be designed or otherwise configured in a number of different ways without departing from the scope of the present invention. The portions 46, 48, 50, receiver 52, and lock 54 will be described in greater detail below.

As discussed above, the first portion 46 is in rotational communication with the crankshaft 26. To that end, the first portion 46 may include an outer gear 56 that engages the chain 32 so as to drive the phaser 38, as discussed above. The first portion 46 may also include a space, generally indicated at 58, to accommodate the second portion 48 (see FIGS. 3 and 10). Further, the first portion 48 may also include a primary inner gear 60 that cooperates with the second portion 48 and the third portion 50 to translate rotation between the camshaft 28 and actuator 42, as discussed in greater detail below. However, those having ordinary skill in the art will appreciate that the first portion 46 could have any shape, structure, or configuration sufficient to be in rotational communication with the crankshaft 26 and the second portion 48 of the phaser 38, as described above, without departing from the scope of the present invention.

Referring now to FIGS. 3 and 10, as discussed above, the second portion 48 is operatively attached to the camshaft 28. To that end, the second portion 48 may include a base plate 62 having an aperture 64 disposed therein, through which a bolt 66 operatively attaches the second portion 48 of the phaser 38 to the camshaft 28. However, it will be appreciated that the second portion 48 could be configured differently and, thus, could be operatively attached to the camshaft 28 in any suitable way without departing from the scope of the present invention.

Referring now to FIGS. 2, 3, 9, and 10, as discussed above, the second portion 48 is in rotational communication with the first portion 46. To that end, the second portion 48 may include a gear section 68 spaced from the base plate 62, with a ring 70 extending between and merging with the base plate 62 and gear section 68, wherein the gear section 68 cooperates with the third portion 50 and the primary inner gear 60 of the first portion 46 so as to translate rotation between the electric motor 42 and the camshaft 28, as discussed in greater detail below. However, it will be appreciated that the second portion 48 could be configured differently and, thus, could be in rotational communication with the first portion 46 in any suitable way without departing from the scope of the present invention.

Figure 5A:
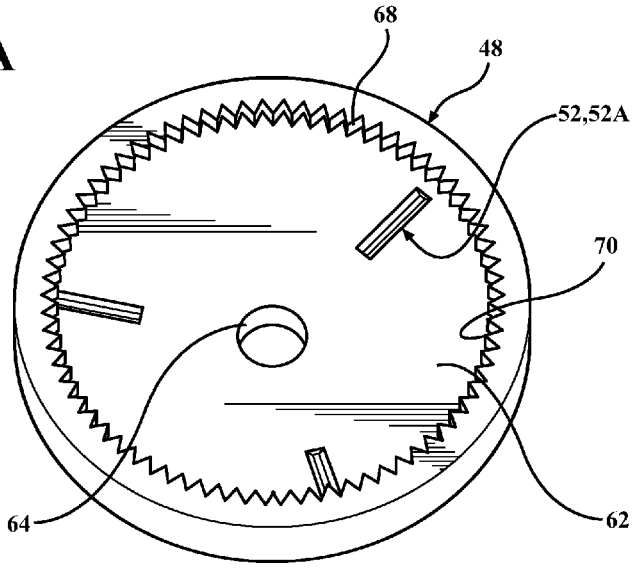
FIGS. 5A-5B are enlarged perspective views of two embodiments of the second portion of the camshaft phaser of FIG. 3.
Figure 5B:
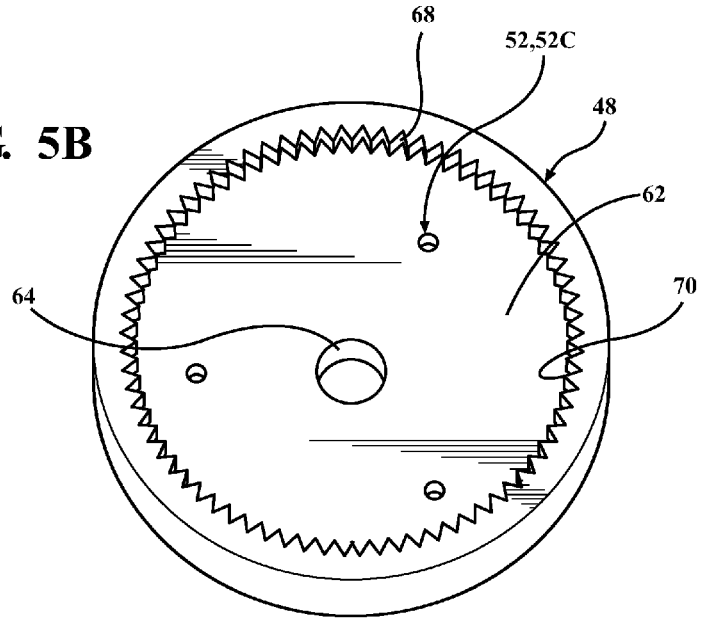
Figure 6A:
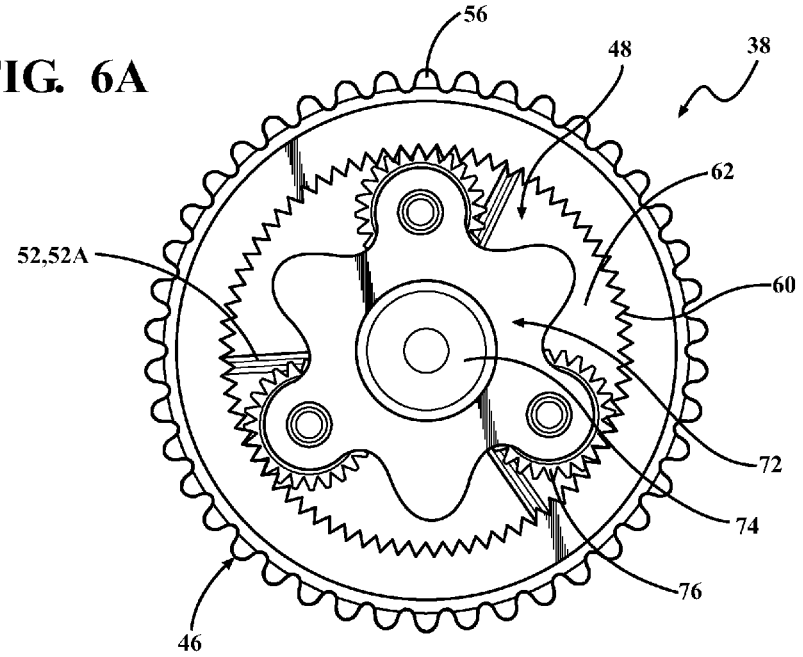
FIGS. 6A-6B are enlarged top plan views of two embodiments of the camshaft phaser of FIGS. 2-3.
Figure 6B:
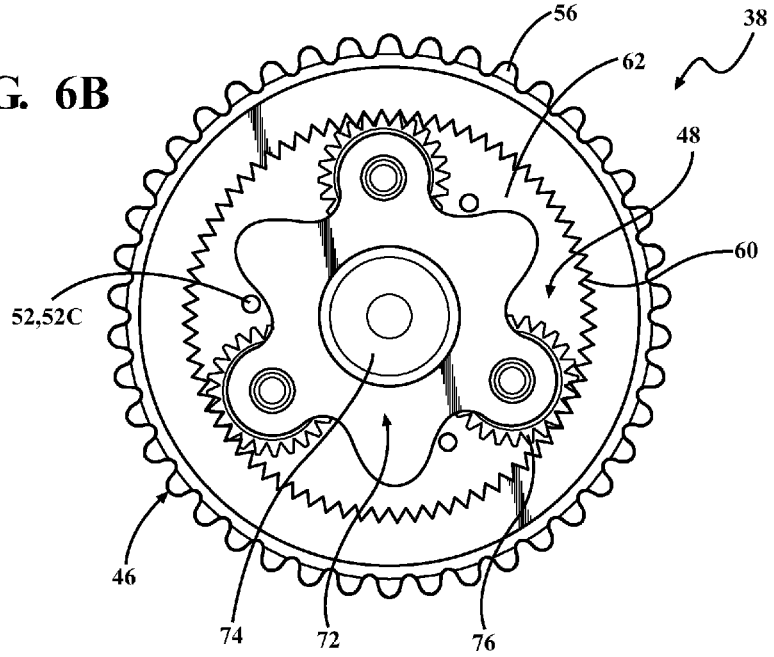
Figure 12:
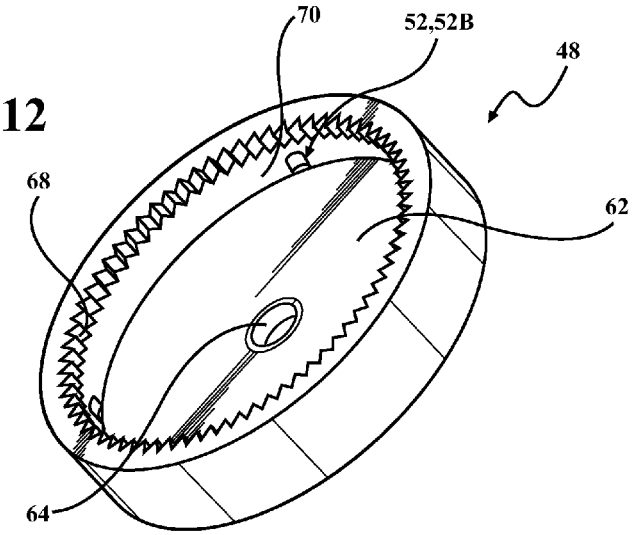
FIG. 12 is an enlarged perspective view of the second portion of the camshaft phaser of FIG. 10.
Figure 13:
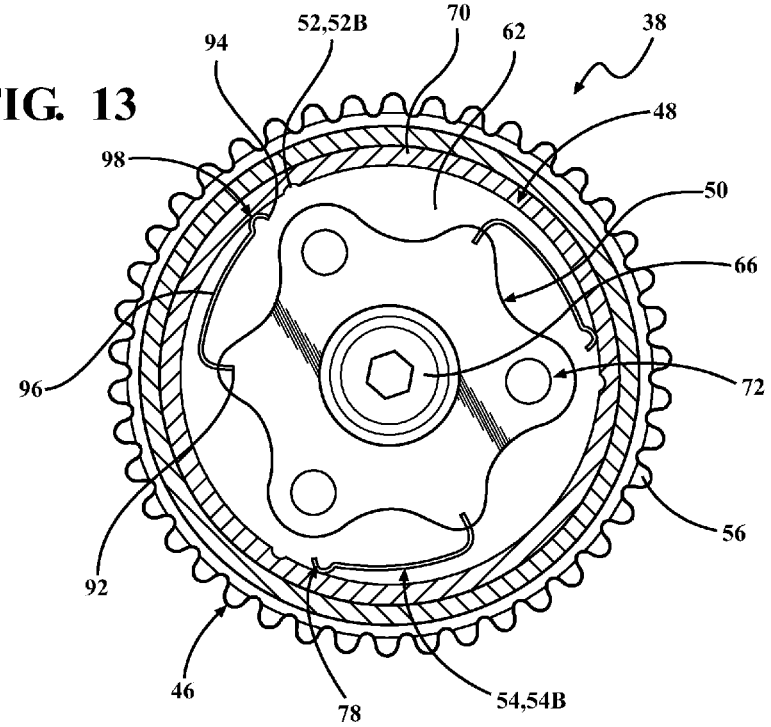
FIG. 13 is a sectional view taken along line 13-13 of FIG. 9 showing the lever springs of FIG. 11 in an unlocked configuration with respect to the second portion of the camshaft phaser.

As noted above, in the representative embodiments illustrated herein, the second portion 48 includes at least one receiver 52 that is releasably engaged by the lock 54. To that end, as will be appreciated from the discussion of the lock 54 below, the receiver 52 could be formed, configured, or disposed in the second portion 48 in a number of different ways without departing from the scope of the present invention. In one embodiment, the second portion 48 of the phaser 38 includes a plurality of receivers 52 radially spaced thereabout, and the third portion 50 of the phaser 48 includes a corresponding plurality of locks 54. While the second portion 48 shown in FIGS. 5A, 5B, and 12 includes three radially-spaced receivers 52, in three separate embodiments (52A, 52B, and 52C, respectively, and discussed in greater detail below), those having ordinary skill in the art will appreciate any suitable number of receivers 52 and/or any suitable number of locks 54 could be utilized without departing from the scope of the present invention. Further, it will be appreciated that the number of receivers 52 could differ from the number of locks 54, such as to implement a number of different stop positions, without departing from the scope of the present invention.

Figure 14:
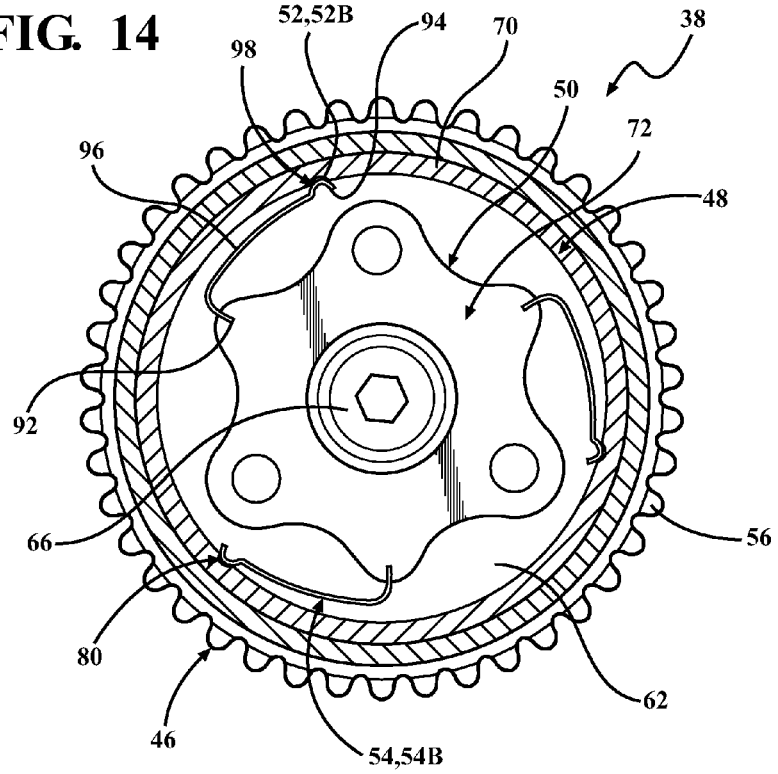
FIG. 14 is an alternate sectional view of FIG. 13 showing the lever springs in a locked configuration with respect to the second portion of the camshaft phaser.

As discussed above, the receiver 52 could be formed in a number of different ways depending on the application. In one embodiment, the receiver 52 of the second portion 48 of the phaser 38 is realized as a slot 52A, 52B (see FIGS. 3, 5A, 6A, and 8A) that cooperates with the lock 54 as described in greater detail below. In another embodiment, the receiver 52 of the second portion 48 of the phaser 38 is realized as a cylindrical aperture 52C (see FIGS. 10, 12, 14, and 14). Moreover, it will be appreciated that the receiver 52, 52A, 52B, 52C could be disposed in any suitable location of the second portion 48 of the phaser 38 without departing from the scope of the present invention. In one embodiment, the receiver 52, 52A, 52C is disposed in the base plate 62 of the second portion 48 of the phaser 38 (see FIGS. 3, 5A-6B, 8A, and 8B). In another embodiment, the receiver 52, 52B is disposed in the ring 70 of the second portion 48 of the phaser 38 (see FIGS. 10, 12, 13, and 14). While the embodiment of the receiver 52, 52B disposed in the ring 70 is formed as a slot 52B, it will be appreciated that the receiver 52B could be of any suitable type or configuration sufficient to cooperate with the lock 54 without departing from the scope of the present invention.

Figure 9:
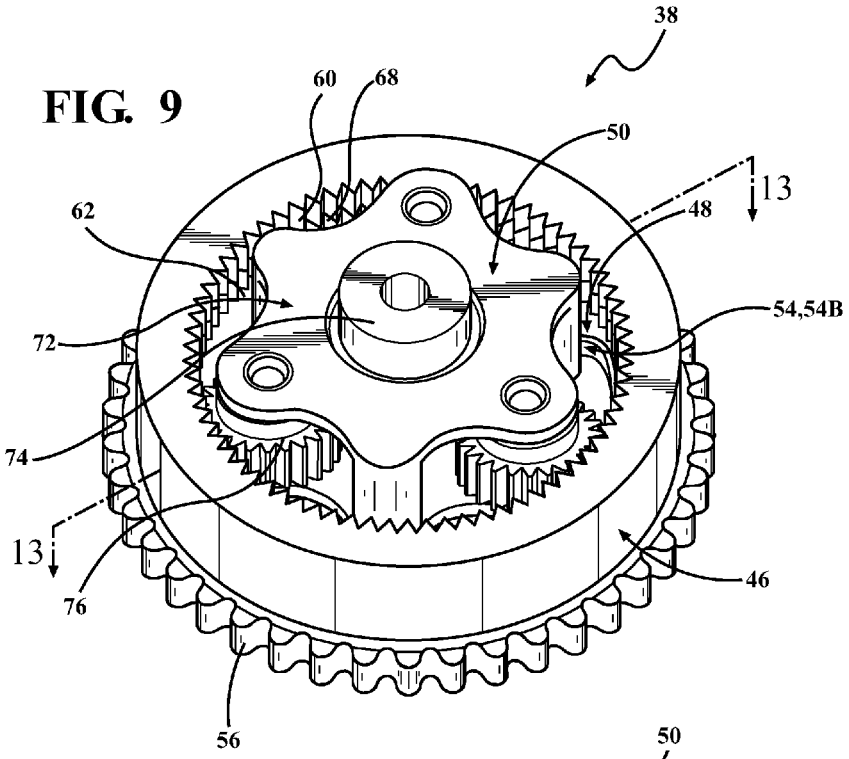
FIG. 9 is an enlarged perspective view of a camshaft phaser in an assembled configuration, according to one embodiment of the present invention.
Figure 11:
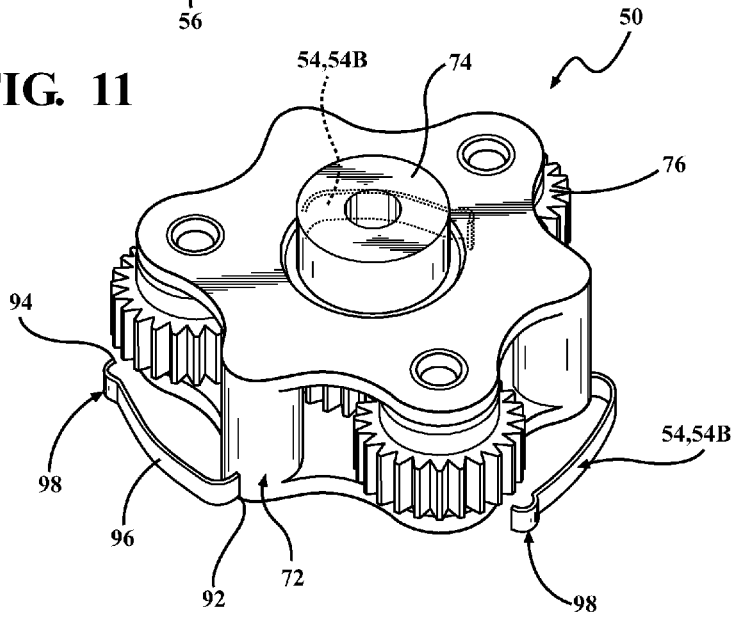
FIG. 11 is an enlarged perspective view of the third portion of the camshaft phaser of FIG. 10 having locks as lever springs.

Referring now to FIGS. 2, 9, and 11, in one embodiment, the third portion 50 of the phaser 38 is realized with a carrier assembly having a bracket body 72, a sun gear 74, and a plurality of planet gears 76. The sun gear 74 is operatively attached to and in rotational communication with the electric motor 42. The planet gears 76 are rotatably supported by the bracket body 72, are disposed radially about the sun gear 74, and are in rotational communication with the sun gear 74 and at least one of the first portion 46 and the second portion 48 of the phaser 38. Specifically, those having ordinary skill in the art will appreciate that the planet gears 76 engage the primary inner gear 60 of the first portion 46, as well as the gear section 68 of the second portion 48. However, the third portion 50 of the phaser 38 could be designed or configured in any way suitable to operatively attach to the electric motor 42 and be in rotational communication with the second portion 48 of the phaser 48, without departing from the scope of the present invention. Further, while the carrier assembly shown in FIGS. 2, 9, and 11 includes three planet gears 76, it will be appreciated that any suitable number of planet gears 76 could be used. Moreover, it will be appreciated that the sun gear 74 and planet gears 76 could be designed, configured, or otherwise oriented differently, or could be interchanged or realized as any other suitable type of gear reduction assembly, without departing from the scope of the present invention.

As discussed above, in the representative embodiments illustrated herein, the third portion 50 of the phaser 38 includes a lock 54 for engaging the receiver 52. The lock 54 has a first position 78 and a second position 80. In the first position 78, the third portion 50 of the phaser 38 and the second portion 48 of the phaser 38 can rotate with respect to each other. In the second position 80, the third portion 50 of the phaser 38 is rotatably coupled to the second portion 48 of the phaser 38. The lock 54 is movable between the first position 78 and the second position 80 in response to a predetermined torque differential occurring between the electric motor 42 and the camshaft 28. Similarly, in one embodiment, the lock 54 is movable between the first position 78 and the second position 80 in response to a predetermined torque differential occurring between the second portion 48 of the phaser 38 and the third portion 50 of the phaser 38.

Figure 8B:
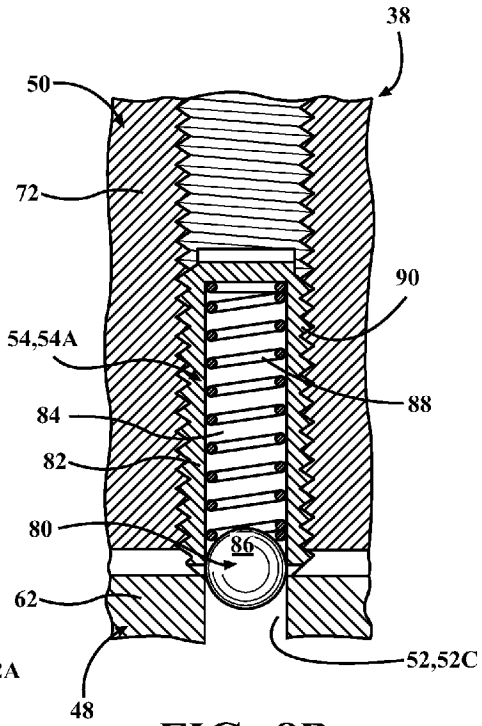
FIGS. 8A-8B are enlarged partial cross-sectional views of the lock assemblies of FIG. 7 in a locked configuration with respect to the two embodiments of the second portion of the camshaft phaser of FIGS. 5A-5B.
Figure 8A:
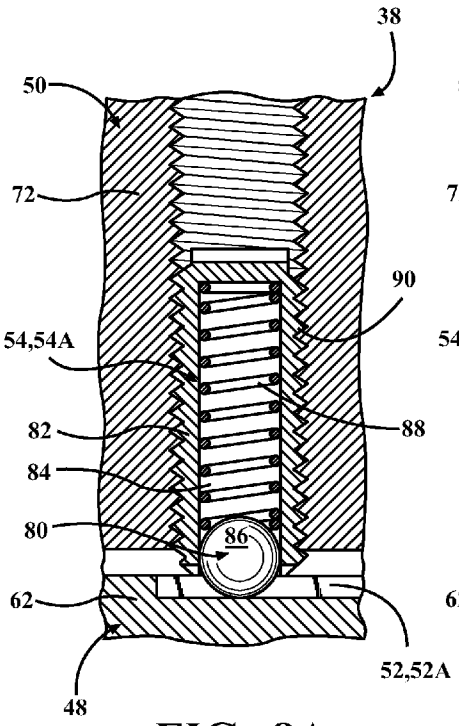
Figure 7:
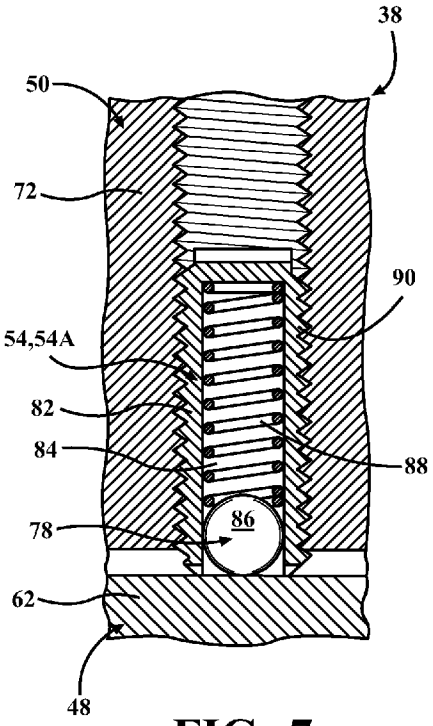
FIG. 7 is an enlarged partial cross-sectional view of the camshaft phaser and lock assemblies of FIG. 2 in an unlocked configuration with respect to the second portion of the camshaft phaser.

Referring now to FIGS. 4 and 7-8, in one embodiment, the lock 54 is realized as a lock assembly 54A which has a body 82 with an inner chamber 84, a key element 86, and a spring 88. The key element 86 is at least partially disposed in the inner chamber 84 and is adapted to releasably engage the receiver 52, 52A, 52C of the second portion 48 of the phaser 38. As shown best in FIGS. 7-8B, the key element 86 is formed as a sphere that releasably engages the receiver 52, 52A, 52C of the base plate 62 of the second portion 48 of the phaser 38. It will be appreciated that the key element 86 of the lock assembly 54A can releasably engage different types of receivers 52, such as the slot 52A and the cylindrical aperture 52C discussed above. Moreover, it will be appreciated that they key element 86 could have any shape or configuration suitable to releasably engage and release the receiver 52, as discussed above, without departing from the scope of the present invention. The spring 88 of the of the lock assembly 54A is disposed in the inner chamber 84 of the body 82 and engages the key element 86 for allowing the lock 54, 54A to move between the first position 78 (see FIG. 7) and the second position 80 (see FIGS. 8A and 8B). While the spring 88 shown in FIGS. 4, and 7-8B is a compression spring, those having ordinary skill in the art will appreciate that the spring 88 could be configured differently without departing from the scope of the present invention. Moreover, the body 82 of the lock assembly 54A may include a threaded portion 90 for adjusting the position and, thus, the engagement between the lock 54 and the receiver 52. However, those having ordinary skill in the art will appreciate that the lock assembly 54A could be configured differently without departing from the scope of the present invention.

Referring now to FIGS. 9-14, in one embodiment, the lock 54 is realized as a lever spring 54B having a first end 92, a second end 94, and a mid portion 96. The first end 92 is operatively attached to the third portion 50 of the phaser 38. The second end 94 is spaced from the first end 92 and has an engagement portion 98 for releasably engaging the receiver 52, 52B of the second portion 48 of the phaser 38. The mid portion 96 extends between and merges with the first end 92 and the second end 94 for allowing the lock 54, 54B to move between the first position 78 (see FIG. 13) and the second position 80 (see FIG. 14). While the mid portion 96 has a curved-shaped profile, those having ordinary skill in the art will appreciate that the mid portion 96 could be configured or shaped differently without departing from the scope of the present invention. Moreover, it will be appreciated that the lever spring 54B could be of any suitable type or have any configuration sufficient to releasably engage the receiver 52, 52B, as discussed above, without departing from the scope of the present invention.

In operation, the lock 54 of the phaser 38 moves to the second position 80 based on relative position under predetermined operating conditions and moves from the second position 80 to the first position 78 based on the predetermined rotational torque differential, as noted above. More specifically, when the lock 54 engages the receiver 52 in the second position 80, the phase of the camshaft 28 can be maintained until rotational torque from the actuator 42 moves the lock 54 to the first position 78. Thus, it will be appreciated that the detent-style configuration of the lock 54 and receiver 52 cooperate passively maintain camshaft 28 phase until the actuator 42 translates sufficient rotational torque to move the lock 54 to the first position 78. Similarly, those having ordinary skill in the art will appreciate that the amount of rotational torque required to move the lock 54 to the first position 78 can be easily adjusted by modifying the configuration, orientation, and/or spacing of the lock 54 and/or the receiver 52. By way of non-limiting example, the geometry of the lever spring 54B or the properties of the compression spring 88 of the lock assembly 54A could be adjusted to cooperate with different types of actuators 42 in a number of different applications.

In this way, the phaser 38 and systems 44 of the present invention significantly reduce the complexity, cost, and packaging size of the phaser 38 and its associated components. Specifically, it will be appreciated that the present invention allows the use of phasers 38 that can lock in predetermined locations that define specific camshaft 28 phase angles. Further, it will be appreciated that the locks 54 are not friction based and function as detents which remain predictable and consistent with use over time, thereby ensuring robustness of the phaser 38 in operation. Further still, the arrangement of the locks 54 and/or receivers 52 afford opportunities for enhanced phasers 38 packaging sizes and geometry, optimized gear reduction, and flexibility with respect to the number of stop positions so as to provide further functionality. Moreover, the present invention reduces the cost of manufacturing camshaft 28 phaser systems 44 that have superior operational characteristics, such as improved performance, control capability, weight, component life and longevity, and efficiency.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A system (44) for controlling the phase between a camshaft (28) and a crankshaft (26) of an internal combustion engine (20), said system (44) comprising:

an actuator (42); and a phaser (38) operatively attached to the camshaft (28) and driven by said actuator (42) so as to selectively control the phase of the camshaft (28), said phaser (38) including: a first portion (46) in rotational communication with the crankshaft (26), a second portion (48) operatively attached to the camshaft (28) and disposed in rotational communication with said first portion (46), and a third portion (50) operatively attached to said actuator (42) and disposed in rotational communication with said second portion (48);

wherein one of said portions of said phaser (38) includes a receiver (52), and another of said portions of said phaser (38) includes a lock (54) for releasably engaging said receiver (52), said lock (54) having:

a first position (78) wherein said portion which includes said receiver (52) and said portion which includes said lock (54) can rotate with respect to each other; and a second position (80) wherein said portion which includes said receiver (52) is rotatably coupled to said portion which includes said lock (54);

said lock (54) being movable between said first position (78) and said second position (80) in response to a predetermined torque differential occurring between said actuator (42) and the camshaft (28).

2. The system (44) as set forth in claim 1, wherein said phaser (38) includes a plurality of radially spaced receivers (52) and a corresponding plurality of locks (54).

3. The system (44) as set forth in claim 1, wherein said second portion (48) of said phaser (38) has a base plate (62), a gear section (68) spaced from said base plate (62), and a ring (70) extending between and merging with said base plate (62) and said gear section (68).

4. The system (44) as set forth in claim 3, wherein said receiver (52) is disposed in said base plate (62) of said second portion (48) of said phaser (38).

5. The system (44) as set forth in claim 4, wherein said lock (54) further includes a lock assembly (54A) having: a body (82) with an inner chamber (84); a key element (86) at least partially disposed in said inner chamber (84) for releasably engaging said receiver (52) of said second portion (48) of said phaser (38); and a spring (88) disposed in said inner chamber (84) and engaging said key element (86) for allowing said lock (54) to move between said first position (78) and said second position (80).

6. The system (44) as set forth in claim 3, wherein said receiver (52) is disposed in said ring (70) of said second portion (48) of said phaser (38).

7. The system (44) as set forth in claim 6, wherein said lock (54) includes a lever spring (54B) having: a first end (92) operatively attached to said third portion (50) of said phaser (38); a second end (94) spaced from said first end (92) and having an engagement portion (98) for releasably engaging said receiver (52) of said second portion (48) of said phaser (38); and a mid portion (96) extending between and merging with said first end (92) and said second end (94) for allowing said lock (54) to move between said first position (78) and said second position (80).

8. The system (44) as set forth in claim 1, wherein said receiver (52) includes a slot (52A/52B).

9. The system (44) as set forth in claim 1, wherein said receiver (52) includes a cylindrical aperture (52C).

10. The system (44) as set forth in claim 1, wherein said third portion (50) of said phaser (38) includes a carrier assembly having: a bracket body (72); a sun gear (74) in rotational communication with said actuator (42); and a plurality of planet gears (76) rotatably supported by said bracket body (72), disposed radially about said sun gear (74), and in rotational communication with said sun gear (74) and at least one of said first portion (46) of said phaser (38) and said second portion (48) of said phaser (38).

11. A phaser (38) actuated by an electric motor (42) for controlling the phase between a camshaft (28) and a crankshaft (26) of an internal combustion engine (20), said phaser (38) comprising:

a first portion (46) in rotational communication with the crankshaft (26);

a second portion (48) operatively attached to the camshaft (28), in rotational communication with said first portion (46), and having a plurality of receivers (52) spaced radially thereabout; and a third portion (50) operatively attached to the electric motor (42), in rotational communication with said second portion (48), and having a plurality of lock assemblies (54A) for releasably engaging said receivers (52) of said second portion (48); said lock assemblies (54A) having: a first position (78) wherein said third portion (50) and said second portion (48) can rotate with respect to each other, and a second position (80) wherein said third portion (50) is rotatably coupled to said second portion (48), said lock assemblies (54A) being movable between said first position (78) and said second position (80) in response to a predetermined torque differential occurring between said second portion (48) and said third portion (50).

12. A phaser (38) actuated by an electric motor (42) for controlling the phase between a camshaft (28) and a crankshaft (26) of an internal combustion engine (20), said phaser (38) comprising:

a first portion (46) in rotational communication with the crankshaft (26);

a second portion (48) operatively attached to the camshaft (28), in rotational communication with said first portion (46), and having a plurality of receivers (52) spaced radially thereabout; and a third portion (50) operatively attached to the electric motor (42), in rotational communication with said second portion (48), and having a plurality of lever springs (54B) for releasably engaging said receivers (52) of said second portion (48), said lever springs (54B) having: a first position (78) wherein said third portion (50) and said second portion (48) can rotate with respect to each other, and a second position (80) wherein said third portion (50) is rotatably coupled to said second portion (48), said lever springs (54B) being movable between said first position (78) and said second position (80) in response to a predetermined torque differential occurring between said second portion (48) and said third portion (50).

13. The phaser (38) as set forth in claim 12, wherein said lever springs (54B) each have: a first end (92) operatively attached to said third portion (50); a second end (94) spaced from said first end (92) and having an engagement portion (98) for releasably engaging said receiver (52) of said second portion (48); and a mid portion (96) extending between and merging with said first end (92) and said second end (94) for allowing said lever spring (54B) to move between said first position (78) and said second position (80).

14. The phaser (38) as set forth in claim 12, wherein said second portion (48) has a base plate (62), a gear section (68) spaced from said base plate (62), and a ring (70) extending between and merging with said base plate (62) and said gear section (68); and wherein said receivers (52) each include a slots (52A/52B) disposed in said ring (70).

15. The phaser (38) as set forth in claim 12, wherein said third portion (50) includes a carrier assembly having: a bracket body (72); a sun gear (74) in rotational communication with the electric motor (42); and a plurality of planet gears (76) rotatably supported by said bracket body (72), disposed radially about said sun gear (74), and in rotational communication with said sun gear (74) and at least one of said first portion (46) and said second portion (48).

* * * * *